US005690044A

United States Patent [19]

Reise et al.

[11] Patent Number: 5,690,044

[45] Date of Patent: Nov. 25, 1997

[54] SYSTEM FOR SHOCK HARDENING A TORPEDO NOSE FAIRING BEARING PLATE ASSEMBLY

[75] Inventors: Christa M. Reise, Portsmouth; James C. Butts, Charlestown, both of R.I.

[73] Assignee: The United States of America as represented by the Secretary of the Navy, Washington, D.C.

[21] Appl. No.: 778,069

[22] Filed: Jan. 16, 1997

[51] Int. Cl.[6] ..... B63B 8/32

[52] U.S. Cl. ..... 114/238; 114/20.1; 89/1.806

[58] Field of Search ..... 114/20.1, 312, 114/316, 318, 319, 238; 89/1.806, 1.809, 1.81; 102/259

[56] References Cited

U.S. PATENT DOCUMENTS

| | | | |
|---|---|---|---|
| 2,137,056 | 11/1938 | Liegeois | 102/259 |
| 3,106,905 | 10/1963 | Gondek | 114/238 |
| 3,893,366 | 7/1975 | Murray | 89/1.806 X |
| 4,191,087 | 3/1980 | Campbell et al. | 89/1.806 |
| 4,616,654 | 10/1986 | Spink et al. | 89/1.806 |
| 5,025,744 | 6/1991 | Moody | 114/238 |
| 5,174,236 | 12/1992 | Moody | 114/238 |

*Primary Examiner*—Michael J. Carone
*Assistant Examiner*—Matthew J. Lattig
*Attorney, Agent, or Firm*—Michael J. McGowan; Robert W. Gauthier; Prithvi C. Lall

[57] ABSTRACT

A system for shock hardening the nose fairing bearing plate assembly of a torpedo by controlling the deformation of the bearing plate under shock loads. A stop bolt within a torpedo tube engages the bearing plate to prevent relative movement between the torpedo tube and the torpedo and to transfer loads between the torpedo housing and the torpedo tube. The system includes providing a tang on the bearing plate to increase bending resistance of the plate and provide a bearing surface which more directly transfers loads from the stop bolt through the bearing plate and into the housing. Additionally, a relief slot is machined into the bearing plate to ensure the bearing plate deforms towards the torpedo and does not interfere with retraction of the torpedo from the tube. Finally, a nose fairing restraint prevents the nose fairing from rotating above the plane of the bearing plate when the deformation of the plate prevents the bearing plate from engaging the nose fairing.

6 Claims, 2 Drawing Sheets

SYSTEM FOR SHOCK HARDENING A TORPEDO NOSE FAIRING BEARING PLATE ASSEMBLY

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

This invention relates to a system for shock hardening a bearing plate and more particularly to a combination of features for improving the deformation characteristics of a torpedo nose fairing bearing plate assembly during in-tube shock testing.

(2) Description of the Prior Art

When a torpedo of current design is loaded within a firing tube of a submarine, a stop bolt within the tube engages a nose fairing and bearing plate on the torpedo in order to prevent relative movement between the torpedo and the tube. During firing, the stop bolt is retracted and the torpedo is accelerated out the tube. Prior to bolt retraction, the tube and torpedo may be subject to shock conditions, such as could be expected if a depth charge were detonated near the submarine. In-tube torpedo testing is conducted to simulate the shock forces which may be encountered during actual operating conditions. The bearing plate absorbs the forces between the tube and torpedo when the tube and torpedo are subjected to shock, either during actual operating conditions or under in-tube test conditions. With the current bearing plate design, the bearing plate is attached to the torpedo housing by bolts near the middle portion of the bearing plate. A rectangular tongue on the bearing plate extends into a corresponding slot on the torpedo housing between the bolts. The stop bolt bears against the forward edge of the bearing plate and the shock forces are transferred through the plate to the torpedo housing by the bolts in shear and by the tongue bearing against the wall of the slot. The shock force may not be completely axial such that bending forces are induced within the bearing plate between the edge of the plate and the first bolt. It has been observed that this bending force may be sufficient to cause the bearing plate to deform out of the plane of the torpedo shell. Slight deformation of the bearing plate under these conditions do not substantially hamper firing of the torpedo. However, the force available for retracting the torpedo from the tube is much less than the firing force and the deformed bearing plate may make retraction very difficult or may inhibit retraction completely. Additionally, the nose fairing is hinged at its forward end and held in place by the bearing plate at its aft end. Sufficient deformation of the bearing plate may allow the spring loaded nose fairing to rotate out of position. The forward hinge of the nose fairing would allow the torpedo to move forward out of the tube when fired. However, with the nose fairing extended beyond the torpedo diameter, the torpedo may become jammed within the tube during retraction.

SUMMARY OF THE INVENTION

Accordingly, it is a general purpose and object of the present invention to provide a system of improvements to the nose fairing bearing plate assembly of a torpedo to shock harden the bearing plate in order to minimize deformation of the bearing plate during in-tube shock loading.

It is a further object of the present invention that the deformation of the bearing plate be controlled such that retraction of the torpedo from the tube can be accomplished should the bearing plate deform.

It is a still further object of the present invention that the nose fairing not rotate out of position and prevent retraction of the torpedo from the tube should the bearing plate deform.

These objects are provided with the present invention by a system of improvements to the nose fairing bearing plate assembly which together control and minimize bearing plate deformation as well as limit nose fairing rotation. A lip, or tang is added to the bearing plate such that it bears directly against the torpedo housing. A greater portion of the shock load is transferred through direct bearing of the plate against the housing and bending deformations of the plate are lessened. Further, a slot is provided along the top portion of the bearing plate opposite the tang. The slot ensures that bending deformation of the bearing plate will be in towards the torpedo centerline and not out of the plane of the torpedo shell. Additionally, a restraint block is provided at the nose fairing hinge, preventing the nose fairing from rotating out of position and causing the torpedo to jam in the tube.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
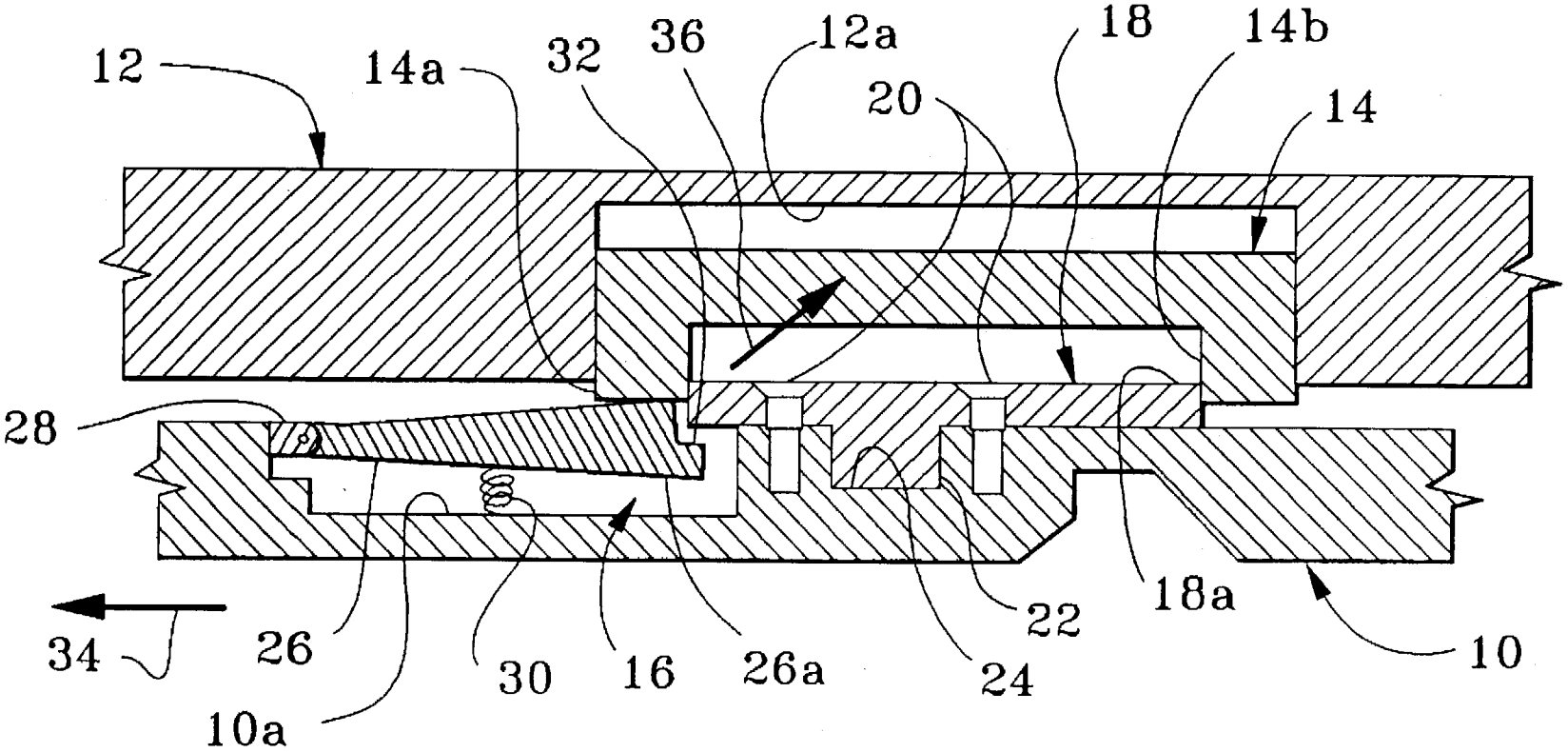
FIG. 1 (PRIOR ART)
FIG. 1 depicts a sectional view of a nose fairing bearing plate assembly of the current design within a torpedo tube.

Referring now to FIG. 1, there is shown a partial sectional view of a torpedo 10 within a torpedo tube 12. Stop bolt 14 within tube 12 engages prior art design nose fairing bearing plate assembly 16. Stop bolt 14 is in the shape of a 'U' having a forward vertical leg 14*a* and an aft vertical leg 14*b*. Bearing plate 18 of assembly 16 fits between forward and aft stop bolt legs 14*a* and 14*b*. Plate 18 is attached to torpedo 10 by bolts 20. Rectangular tongue 22 of bearing plate 18 extends into slot 24 of torpedo 10 between bolts 20. Nose fairing 26 of assembly 16 is attached to torpedo 10 by forward hinge 28. Forward leg 14*a* depresses aft end 26*a* of nose fairing 26 into torpedo recess 10*a*. During loading and firing of torpedo 10, stop bolt 14 is retracted into recess 12*a* of tube 12 allowing unobstructed passage of torpedo 10 through tube 12. Spring 30 rotates aft end 26*a* of nose fairing 26 about hinge 28 until lip 32 engages bearing plate 18. This position of nose fairing 26 provides torpedo 10 with a smooth hydraulic surface when torpedo 10 is fired from tube 12 in the direction of arrow 34. If torpedo 10 and tube 12 are subjected to shock loading, the transfer of forces between forward leg 14*a* and bearing plate 18 may be such that a force in the direction of arrow 36 induces bending in bearing plate 18, deforming bearing plate 18 away from torpedo 10 in the direction of arrow 36. In some cases, this deformation is large enough that lip 32 does not engage plate 18, allowing aft end 26*a* of nose fairing 26 to rotate above the plane of bearing plate surface 18*a*. It has been observed that the large forces needed to fire torpedo 10 from tube 12 are sufficient to overcome the resistance of deformed plate 18 against tube 12. However, the relatively smaller force available to retract torpedo 10 from tube 12 in the direction opposite arrow 34 cannot overcome this resistance. Also, any obstructions encountered by aft end 26*a* as torpedo 10 moves in the direction of arrow 34 would simply depress aft end 26*a* into torpedo recess 10*a*, but aft end 26*a* would hang up on obstructions when moving in the opposite direction. The result of not having sufficient force to overcome the resistance of deformed plate 18 against tube 12 and of aft end 26*a* encountering obstructions may cause torpedo 10 to jam within tube 12 when trying to retract torpedo 10 from tube 12.

Figure 2:
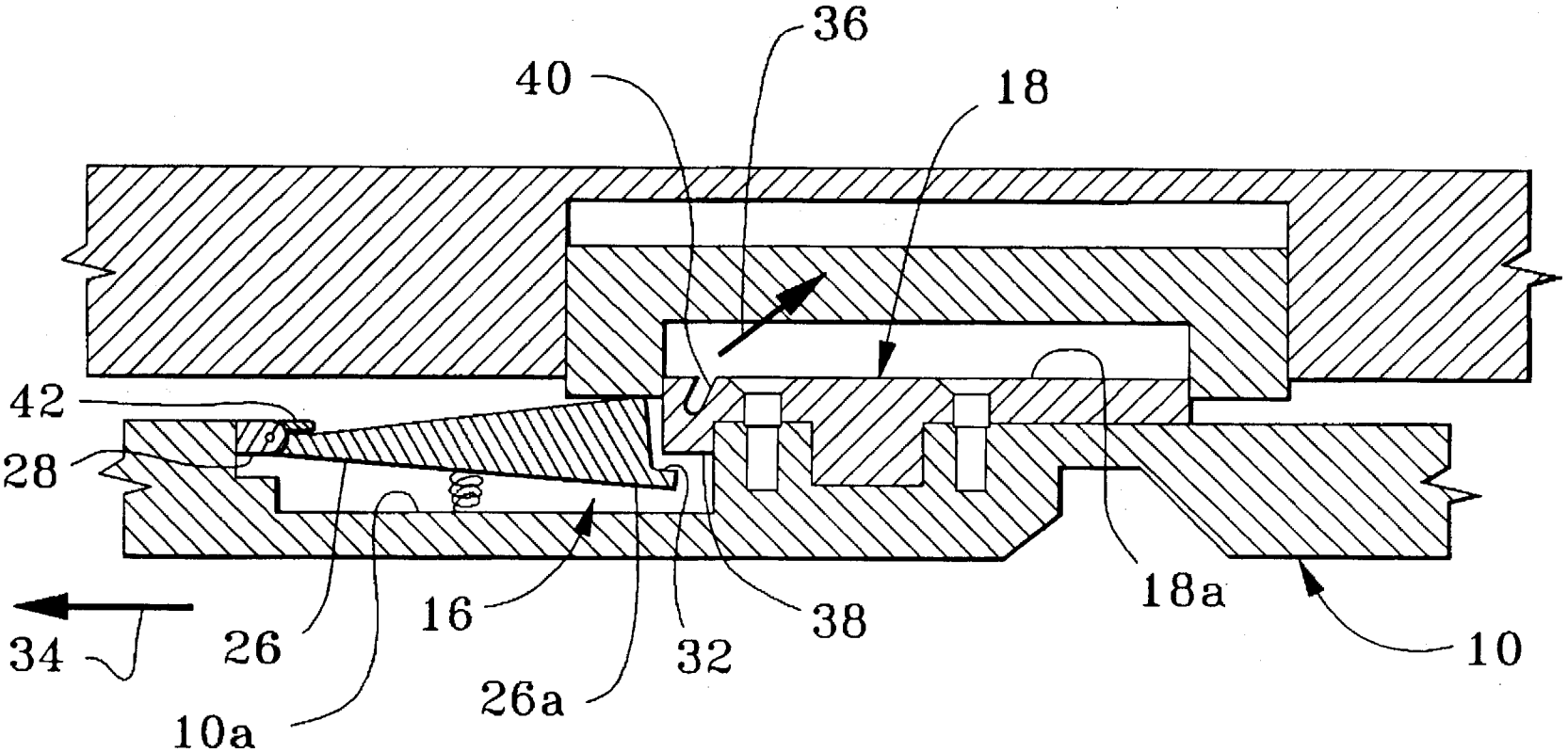
FIG. 2 depicts a sectional view of a shock hardened nose fairing bearing plate assembly within a torpedo tube.

Referring now to FIG. 2, there is shown a system for hardening assembly 16 against shock loading. The system includes tang 38, relief slot 40 and nose restraint 42. Tang 38 is essentially a thickened portion of plate 18 extending into torpedo recess 10*a*. If a shock loading generates a force in the direction of arrow 36, bending of plate 18 is minimized as the force can now be transferred more directly to torpedo 10 through tang 38. Additionally, the thickened area presents a larger cross section for resisting bending. As indicated in FIG. 2, the geometry of nose fairing 26 has been altered slightly to accommodate tang 38. To further control deformation, relief slot 40 is machined into plate 18. The slot is angled in a direction opposite firing direction 34 to encourage plate 18 to deform by folding in on itself rather bending outward as in the prior art plate of FIG. 1. Finally, nose restraint 42 has been added at hinge 28. Nose restraint 42 prevents rotation of aft end 26*a* past the plane of surface 18*a* if deformation of bearing plate 18 is such that lip 32 does not engage bearing plate 18.

What has thus been described is a system for shock hardening the nose fairing bearing plate assembly of a torpedo. The system is used to control deformation of the bearing plate under shock loads when the torpedo is within a torpedo tube. The system allows for ease in retracting the torpedo from the tube without requiring excessive force to overcome resistance of the torpedo against the tube as a result of shock load induced deformation of the bearing plate. The system further prevents the extension of the nose fairing above the plane of the bearing plate. The nose fairing is hinge mounted at one end to the torpedo housing. The other end has an extension which engages the underside of the bearing plate. A spring keeps the nose fairing in position against the bearing plate. If the bearing plate deforms excessively under shock loads, the nose fairing extension does not engage the plate and the spring forces the nose fairing to rotate about the hinge such that the extension is above the plane of the bearing plate. In retracting the torpedo from the tube, the extension can cause the torpedo to the jam within the tube. The shock loads may be as a result of operational conditions or may be induced as part of in-tube testing of the torpedo. The loads are transferred between the torpedo tube and torpedo by means of the bearing plate being fit between the flanges of a stop bolt secured to the tube. The system includes providing a tang on the forward end of the bearing plate susceptible to deformation. The tang extends adjacent the torpedo housing into a housing recess and serves to thicken the plate so as to decrease plate deformation caused by bending forces on the plate. Additionally, the tang provides a bearing surface which more directly transfers loads from the stop bolt through the bearing plate and into the housing. Another feature of the system is a relief slot machined into the top surface of the bearing plate in the vicinity of the tang. The slot is formed such that the plate has a tendency to deform downward towards the torpedo housing rather than upwards towards the torpedo tube. A still further feature is a nose restraint provided at the nose restraint hinge. The restraint prevents the nose fairing from rotating to where the nose fairing extension would be above the plane of the bearing plate when the extension fails to engage the bearing plate.

While a preferred embodiment of the invention has been disclosed in detail above, it should be understood by those skilled in the art that various other embodiments of the invention are possible. For example, other methods for limiting the rotation of the nose fairing may be used, including a piston and cylinder type connection between the nose fairing and the housing.

In light of the above, it is therefore understood that within the scope of the appended claims, the invention may be practiced otherwise than as specifically described.

What is claimed is:

1. A system for shock hardening and controlling deformation of a bearing plate, the plate transferring loads from a first member bearing against the plate to a second member bearing against the plate, the system comprising:

a tang affixed to one end of the bearing plate and adjacent the first member, the tang providing an increased bearing surface between the first member and the plate, the tang further providing an increased bending resistance in the plate in a direction toward the second member; and a slot cut into a surface of the bearing plate remote from the first member, the slot encouraging the deformation of the plate in a direction away from the second member.

2. The system according to claim 1 wherein the bearing plate forms a part of a nose fairing bearing plate assembly, the bearing plate maintaining a maximum rotation of a nose fairing of the assembly by engaging a first end of the nose fairing, the nose fairing having a hinged joint connecting a second end of the nose fairing remote from the first end to the first member, the system further comprising a stop, the stop preventing rotation of the nose fairing beyond the maximum rotation when deformation of the bearing plate prevents the bearing plate from engaging the nose fairing.

3. A system according to claim 2 wherein the stop comprises an extension protruding from the hinge joint and engaging the second end of the nose fairing to prevent rotation of the nose fairing beyond the maximum rotation.

4. A system for shock hardening and controlling deformation in a nose fairing bearing plate assembly of a torpedo, the assembly having a bearing plate for transferring loads from a first member bearing against the plate to a second member bearing against the plate, the plate further maintaining a maximum rotation of a nose fairing of the assembly in a direction towards the second member by engaging a first end of the nose fairing, the nose fairing having a hinge joint connecting a second end of the nose fairing remote from the first end to the first member, the system comprising a hinge stop, the stop preventing rotation of the nose fairing beyond the maximum rotation when deformation of the bearing plate prevents the bearing plate from engaging the nose fairing.

5. The system according to claim 4 further comprising a slot cut into a surface of the bearing plate remote from the first member, the slot encouraging the deformation of the plate in a direction away from the second member.

6. A system for reducing a retraction force required to remove a torpedo nose fairing bearing plate from a torpedo tube, the assembly having a bearing plate for transferring loads between the torpedo and the torpedo tube, the plate further maintaining a maximum rotation of a nose fairing of the assembly in a direction towards the torpedo tube by engaging a first end of the nose fairing, the nose fairing being hinged at a second end remote from the first end, the system comprising:

a hinge stop, the stop preventing rotation of the nose fairing beyond the maximum rotation when deformation of the bearing plate prevents the bearing plate from engaging the nose fairing;

a slot cut into a surface of the bearing plate remote from the torpedo, the slot encouraging the deformation of the plate in a direction away from the torpedo tube; and a tang affixed to one end of the bearing plate and adjacent the torpedo, the tang providing an increased bearing surface between the torpedo and the plate, the tang further providing an increased bending resistance in the plate in a direction toward the torpedo tube.

* * * * *